US007513543B2

(12) United States Patent
Erskine

(10) Patent No.: US 7,513,543 B2
(45) Date of Patent: Apr. 7, 2009

(54) SUPPORT BAR ASSEMBLY FOR DECK HATCH

(75) Inventor: Edward J. Erskine, Benson, NY (US)

(73) Assignee: Taylor Made Group, Inc., Gloversville, NY (US)

( * ) Notice: Subject to any disclaimer, the term of this patent is extended or adjusted under 35 U.S.C. 154(b) by 182 days.

(21) Appl. No.: 11/248,322

(22) Filed: Oct. 13, 2005

(65) Prior Publication Data

US 2007/0085351 A1 Apr. 19, 2007

(51) Int. Cl.
*E05C 17/04* (2006.01)

(52) U.S. Cl. ..... 292/262; 292/267

(58) Field of Classification Search ..... 292/259 R, 292/339, 262–276, 338, 278, 367, 374
See application file for complete search history.

(56) References Cited

U.S. PATENT DOCUMENTS 909,563 A * 1/1909 Dorn ..... 292/267
1,397,450 A * 11/1921 Penny ..... 292/305
1,398,768 A * 11/1921 Burtis ..... 292/267
1,711,282 A * 4/1929 Orr ..... 292/267
4,215,885 A 8/1980 McCray
4,811,680 A 3/1989 Genth
4,878,701 A * 11/1989 Rondel et al. ..... 292/288
5,353,547 A 10/1994 Foster
6,161,657 A * 12/2000 Zhuang et al. ..... 188/67
6,308,650 B1 10/2001 Tsumiyama et al.

* cited by examiner

*Primary Examiner*—Gary Estremsky
(74) *Attorney, Agent, or Firm*—Nixon & Vanderhye P.C.

(57) ABSTRACT

A support bar assembly for a pivot member pivotably supported by a frame serves to substantially fix the pivot member relative to the frame in an open position. The assembly includes a support arm body securable at an end to the frame. A rack arm is securable to the pivot member and is slidably mounted in the support arm body between a closed position and an open position. A cam lock affixed to the support arm body is movable between at least a release position, in which the rack arm is freely slidable in the support arm body, and a lock position, in which the rack arm is substantially fixed in the support arm body.

19 Claims, 4 Drawing Sheets

SUPPORT BAR ASSEMBLY FOR DECK HATCH

CROSS-REFERENCES TO RELATED APPLICATIONS (NOT APPLICABLE)

STATEMENT REGARDING FEDERALLY SPONSORED RESEARCH OR DEVELOPMENT (NOT APPLICABLE)

BACKGROUND OF THE INVENTION

The present invention relates to a support bar assembly for a pivot member supported by a frame such as a deck hatch and, more particularly, to a support bar assembly for substantially fixing the pivot member in an open position.

A deck hatch may be found in a marine vessel deck and is typically operated or opened by pushing outward or upward on the hatch from beneath the deck, e.g., from the cabin or the like. Supporting structure to keep the deck hatch open typically utilizes a threaded knob or the like engageable with a support shaft. The knob, however, is difficult to manipulate. Additionally, with the conventional structure, it is difficult to set an appropriate locking force, where a locking force that is too tight may damage to the support structure, frame or hatch upon impact with the deck hatch in a locked open position, and a locking force that is too loose may inadvertently release the deck hatch, e.g., when the boat rocks or upon light impact with the hatch.

BRIEF SUMMARY OF THE INVENTION

It remains desirable, however, to incorporate structure into a deck hatch or other panel opening that will fix the deck hatch in an open position while preventing damage to the hatch, frame or support structure upon impact with the hatch in the locked open position. Such structure is effected by the support bar assembly of the invention, which is attachable between the deck hatch or other panel and its supporting frame. A "frame" in the context of the present invention means any support over which the panel or deck hatch rests in the closed position. For example, the supporting frame could be a structured frame member set into an opening, or the supporting frame could simply be an area around an opening over which the panel or hatch closes. The support bar assembly includes locking structure that is configured to permit the lock to release upon an application of a predetermined force.

In an exemplary embodiment of the invention, a support bar assembly supports a pivot member which is pivotably supported by a frame. The support bar assembly includes a support arm body securable at an end to the frame. A rack arm is securable to the pivot member and slidably mounted in the support arm body between a closed position and an open position. A cam lock is affixed to the support arm body and is movable between at least a release position, in which the rack arm is freely slidable in the support arm body, and a lock position, in which the rack arm is substantially fixed in the support arm body. The support arm body preferably includes a lock member disposed between the cam lock and the rack arm, where the cam lock urges the lock member against the rack arm in the lock position. In this context, the rack arm may include a plurality of arm ridges defining a rack, where the lock member may include a plurality of locking ridges sized substantially corresponding to the arm ridges. The lock member is positioned such that the locking ridges are disposed facing the arm ridges.

The cam lock preferably includes an engaging member, a lever, and a spring member disposed between the engaging member and the lever, where the engaging member engages the lock member in the lock position. The spring coefficient is preferably set to enable the cam lock in the lock position to release upon an application of a predetermined force on the rack arm. The spring coefficient is set by a thickness of the spring member.

In a preferred arrangement, the lock member is integral with the support arm.

The rack arm may include an aluminum sleeve disposed surrounding a plastic strip defining a rack. In this context, the rack is preferably defined by a plurality of arm ridges formed in the plastic strip.

The cam lock and the support arm body are preferably configured such that when the rack arm is removed from the support arm body, the cam lock is movable from the release position, past the lock position, to an insert position, where the cam lock is removable from the support arm body in the insert position. The support arm body includes a pair of cam lock support arms disposed in a facing relationship, an inside surface of each of the cam lock support arms including a slot, where the cam lock has a pair of tabs on each side thereof that are securable in the slots of the cam lock support arms. In a related context, the cam lock includes an engaging member, a lever, and a spring member disposed between the engaging member and the lever, where in the lock position, the engaging member is positioned to lock the rack arm by an over-center locking arrangement via the spring member.

In another exemplary embodiment of the invention, an assembly for pivotably supporting a panel includes a panel frame pivotably supporting the panel via a hinge, and at least one support bar assembly of the invention secured adjacent the hinge between the panel frame and the panel.

In still another exemplary embodiment of the invention, a cam lock for locking against a lock member includes an engaging member; a lever; and a spring member disposed between the engaging member and the lever. The cam lock is pivotable via the lever between a locked position where the engaging member engages the lock member and a release position where the engaging member is disengaged from the lock member. The spring member comprises a spring coefficient, where the spring coefficient is set to enable the cam lock in the locked position to release upon an application of a predetermined force on the lock member.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
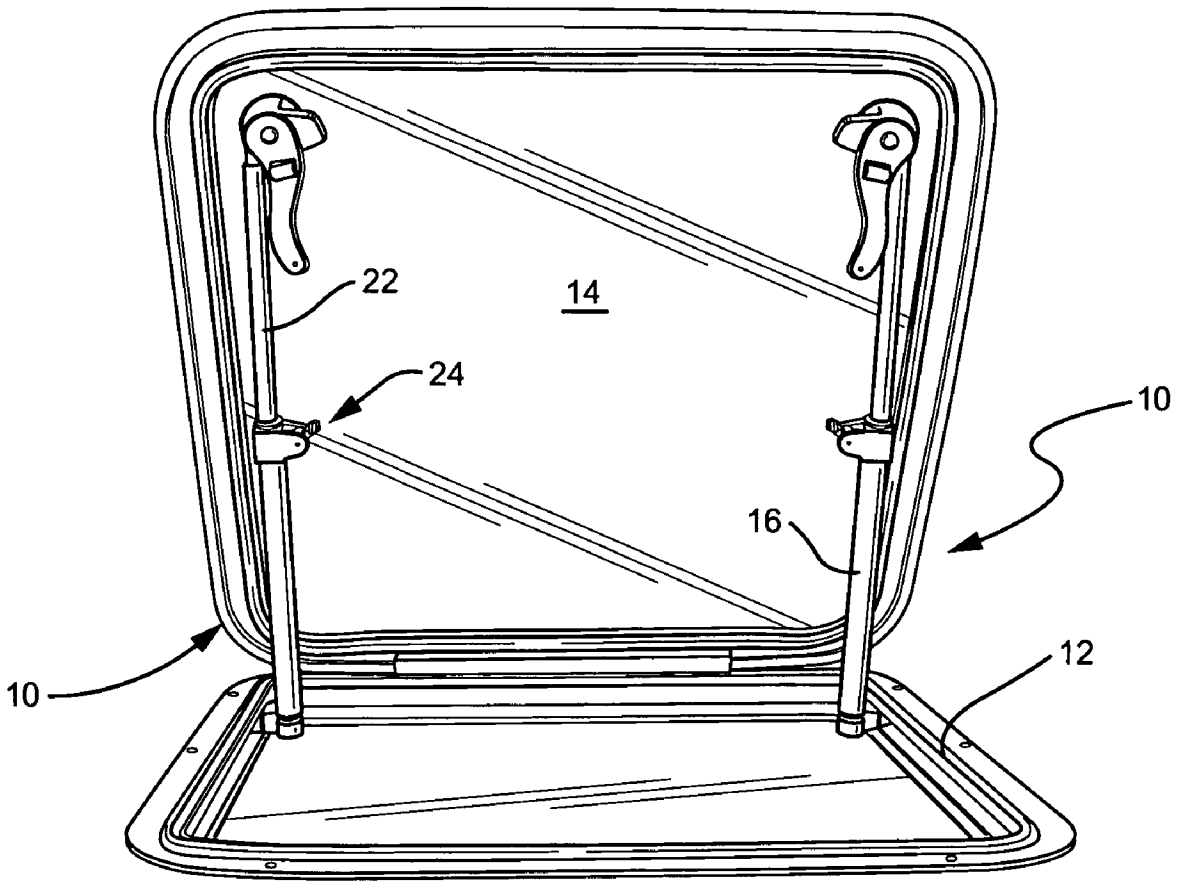
FIG. 1 shows a pair of support bar assemblies supporting a deck hatch in an open position.

FIG. 1 illustrates an exemplary application of the support bar assembly 10 of the present invention. As shown, two support bar assemblies 10 are disposed between a frame 12 and a pivot member 14 such as a deck hatch. Although the support bar assembly of the invention is shown and described in connection with its application to a deck hatch, those of ordinary skill in the art will appreciate that a support bar assembly may be suited for use with any pivot member or panel, and the invention is not necessarily meant to be limited to the described deck hatch application.

Figure 2:
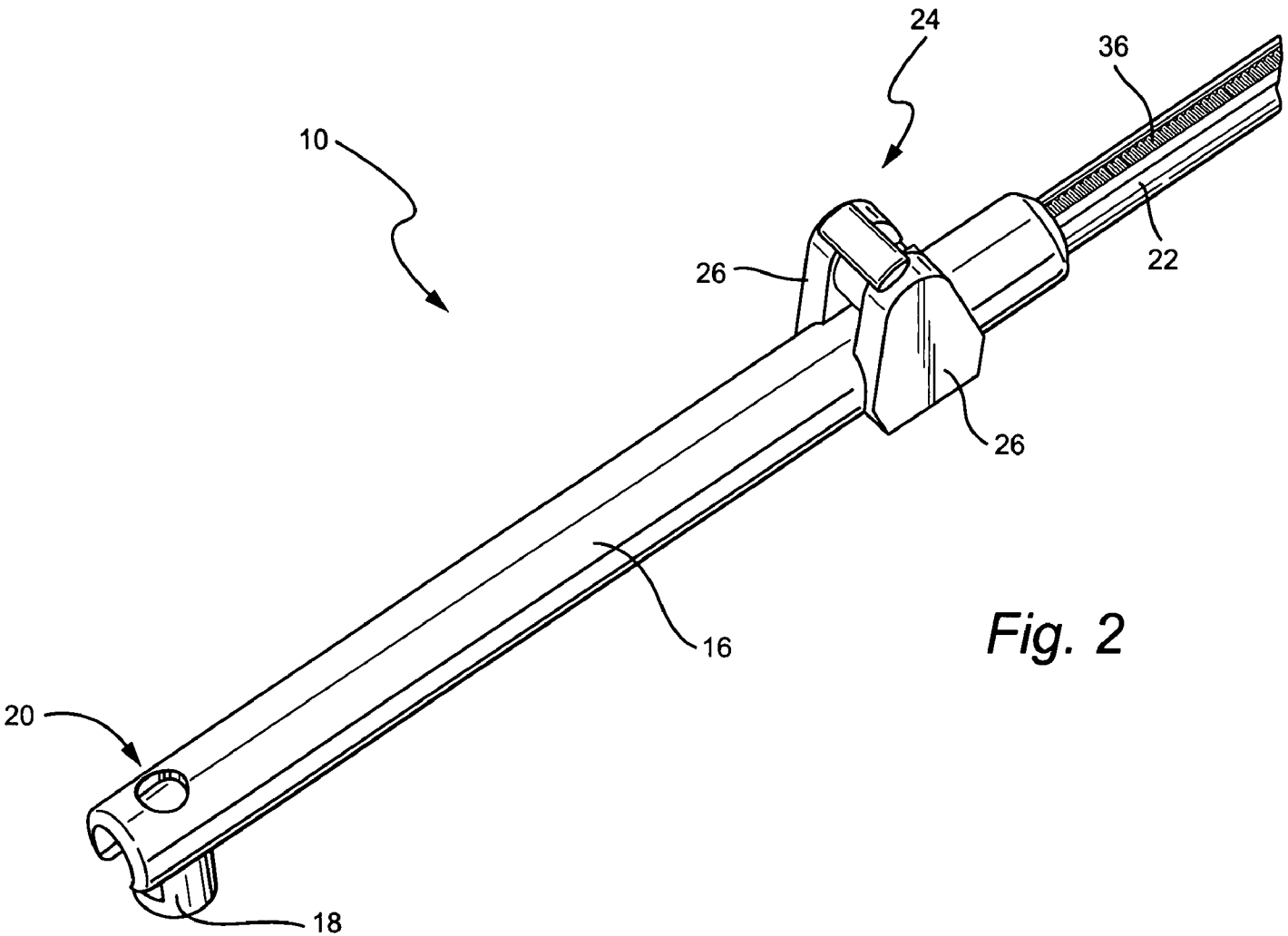
FIG. 2 is a perspective view of a support bar assembly of the invention.
Figure 3:
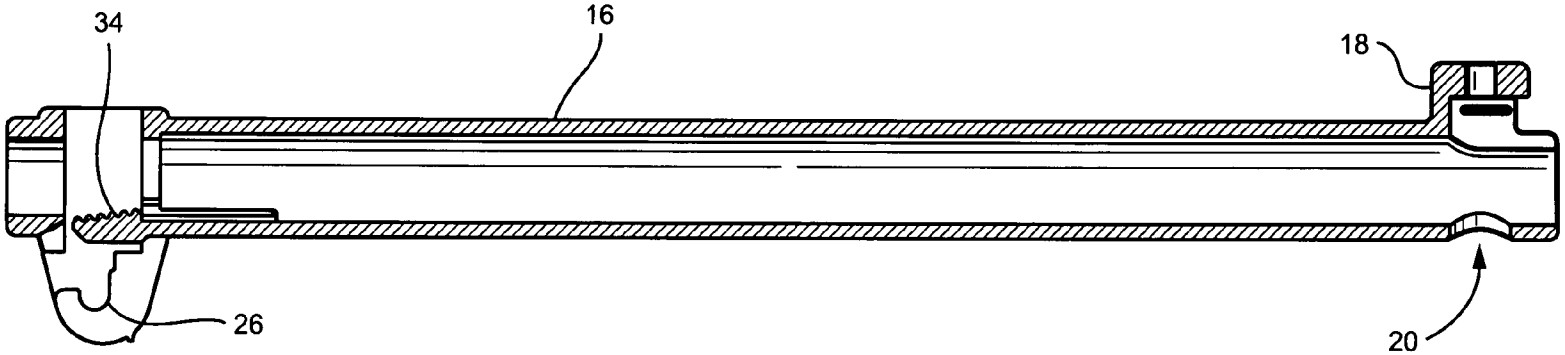
FIG. 3 is a cross sectional view of the support arm body of the support bar assembly.

The support bar assembly 10 includes a support arm body 16 securable at an end to the frame 12. As shown in FIGS. 2 and 3, the end includes a connector aperture housing 18 and an aperture 20 therethrough. The aperture 20 is larger at one end and smaller in the aperture housing 18 as shown in FIG. 3. In a preferred embodiment, the aperture housing 18 is secured to the frame 12 via a rivet or like connector through the small section of the aperture 20. The larger section of the aperture 20 provides access to the rivet or connector if service or replacement is required. In this instance, a repair kit may be included with a replacement support bar assembly including a drive rivet or like connector if necessary to connect the new support arm body to the frame 12.

A rack arm 22 is slidably mounted in the support arm body 16 and positionable between a closed position and an open position (the open position is illustrated in FIG. 1). An end of the rack arm 22 farthest from the support arm body 16 is secured to the pivot member 14 in any suitable manner. The rack arm 22 is preferably formed via an aluminum sleeve disposed surrounding a plastic strip defining the rack. As shown in FIG. 2, arm ridges 36 are formed in the plastic strip to define a rack.

Figure 5:
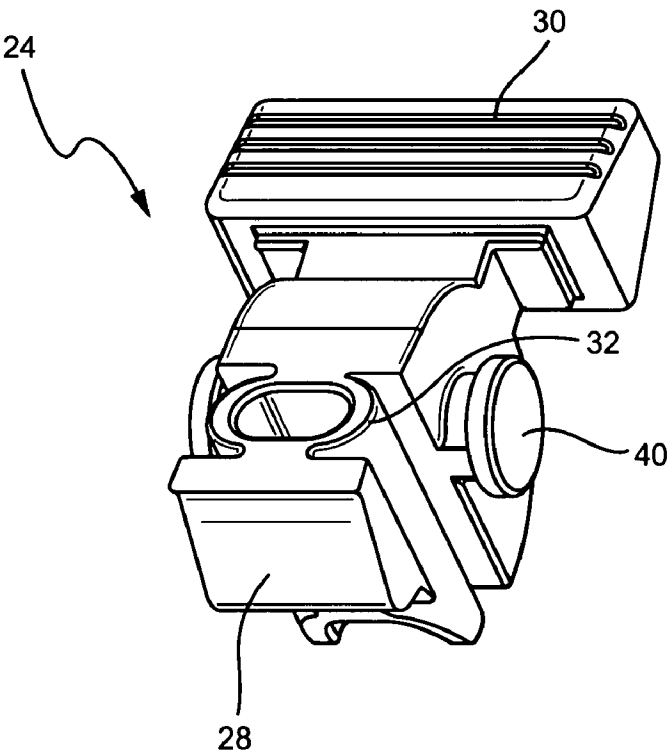
FIG. 5 is a perspective view of the cam lock.
Figure 4:
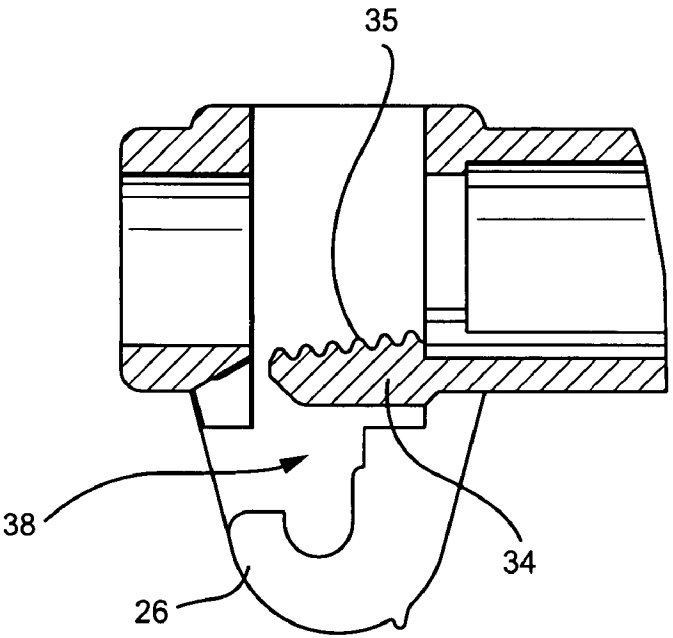
FIG. 4 is a close-up sectional view of an end of the support arm body that supports the cam lock.

A cam lock 24 is affixed to the support arm body 16 via a pair of cam lock support arms 26 preferably formed integral with the support arm body 16 and disposed in a facing relationship as shown in FIGS. 2-4. With reference to FIG. 5, the cam lock 24 includes an engaging member 28, a lever 30, and a spring member 32 disposed between the engaging member 28 and the lever 30. The cam lock 24 is movable between a release position, in which the rack arm 22 is freely slidable in the support arm body 16, a lock position, in which the rack arm 22 is substantially fixed in the support arm body 16, and an insert position accessible only when the rack arm 22 is removed from the support arm body 16 such that the cam lock 24 is movable from the release position, past the lock position, to the insert position, where the cam lock 24 is removable from the support arm body 16.

With continued reference to FIGS. 3 and 4, each of the facing cam lock support arms 26 includes a slot 38 on an inside surface. The slots 38 are sized and shaped to receive a pair of tabs 40 on each side of the cam lock 24. The cam lock 24 is structured so that the tabs 40 can only fit through the slot 38 with the cam lock in the insert position. With the rack arm 22 removed, the cam lock 24 is rotatable from beyond the lock position to the release position, where the rack arm 22 can be inserted into the support arm body 16. With the rack arm 22 inserted in the support arm body 16, the cam lock 24 is prevented from being pivoted to the install position.

The support arm body 16 includes a preferably integrated lock member 34 disposed between the cam lock 24 and the rack arm 22. In a preferred arrangement, the lock member 34 includes a plurality of corresponding locking ridges 35 sized substantially corresponding to the arm ridges 36 of the rack arm 22. Assembled, the lock member 34 is positioned such that the locking ridges 35 are disposed facing the arm ridges 36. In use, in the lock position, the engaging member 28 of the cam lock 24 urges the lock member 34 and locking ridges 35 against the arm ridges 36 of the rack arm 22 in an over-center locking arrangement effected via the spring member 32. In a locked position, the locking ridges 35 thus engage the arm ridges 36 to substantially fix the position of the rack arm 22 relative to the support arm body 16.

The spring member 32 of the cam lock 24 is formed via an opening, e.g. oval shaped, generally adjacent the engaging member 28. A spring coefficient of the spring member 32 is controlled by a thickness of the spring member 32 and is set to enable the cam lock 24 in the lock position to release upon an application of a predetermined force, which is dependent on the size of the supported panel, its intended use, etc. In an exemplary arrangement, with a 20"×20" deck hatch, the spring coefficient is set to resist a force up to 150 lbs. of linear force along the rack arm 22 before releasing. Upon the occurrence of a force exceeding the limit, the spring member 32 will enable the locking ridges 35 to safely disengage from the arm ridges 36 and thereby prevent damage to the panel, frame or support structure.

In use, with the cam lock 24 in the release position, the deck hatch or other panel 14 can be freely pivoted in the frame 12. When the panel 14 is placed at a desired position, the cam lock 24 is pivoted via the lever 30 to the lock position in an over-center locking arrangement via the spring member 32, thereby urging the lock member 34 toward the rack arm 22 to engage the locking ridges 35 and arm ridges 36. In the lock position, depending on the spring coefficient of the spring member 32, the panel 14 is held substantially fixed up to a predetermined linear force along the rack arm 22. To release the rack arm 22 so that it is freely slidable in the support arm body 16, the cam lock 24 is pivoted back to the release position via the lever 30. A stop member (not shown) is secured preferably by a screw or like connector on the end of the rack arm 22 disposed inside the support arm body 16. The stop member serves as a stop limit for opening the hatch or panel 14. In order to disassemble or replace the cam lock 24, after removing the stop member, the rack arm 22 can be removed from the support arm body 16 with the cam lock 24 in the release position; subsequently, the cam lock 24 is movable from the release position, past the lock position, to the insert position, and the cam lock 24 can be removed if desired via the slots 38 in the cam lock support arms 26.

With the support bar assembly of the present invention, a panel or pivot member such as a deck hatch can be substantially fixed in an open position without risking damage to the support structure, panel or supporting frame upon impact beyond a predetermined force. The support bar assembly includes inexpensive and easily manufactured components and is easily installed.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A panel assembly comprising:

a frame;

a pivot member pivotably supported by the frame;

a support arm body secured at an end to the frame;

a rack arm secured to the pivot member and slidably mounted in the support arm body between a closed position in which the pivot member is pivoted closed in the frame and an open position in which the pivot member is pivoted open in the frame; and a cam lock affixed to the support arm body, the cam lock being movable between at least a release position, in which the rack arm is freely slidable in the support arm body, and a lock position, in which the cam lock is cooperable with a lock member to engage the rack arm, and the rack arm is substantially fixed in the support arm body against movement toward both the closed position and the open position, wherein the cam lock comprises structure such that in the lock position, the cam lock substantially fixes the rack arm in the support arm body by an over-center locking arrangement.

2. A panel assembly according to claim 1, wherein the support arm body comprises the lock member disposed between the cam lock and the rack arm, the cam lock urging the lock member against the rack arm in the lock position.

3. A panel assembly according to claim 2, wherein the rack arm comprises a plurality of arm ridges defining a rack, and wherein the lock member comprises a plurality of locking ridges sized substantially corresponding to the arm ridges, the lock member being positioned such that the locking ridges are disposed facing the arm ridges.

4. A panel assembly according to claim 1, wherein the cam lock and the support arm body are configured such that when the rack arm is removed from the support arm body, the cam lock is movable from the release position, past the lock position, to an insert position, and wherein the cam lock is removable from the support arm body in the insert position.

5. A panel assembly according to claim 1, wherein the support arm body comprises a pair of cam lock support arms disposed in a facing relationship, an inside surface of each of the cam lock support arms including a slot, wherein the cam lock comprises a pair of tabs on each side thereof, the tabs being securable in the slots of the cam lock support arms.

6. A panel assembly according to claim 1, wherein the cam lock comprises a spring member having a spring coefficient, the spring coefficient being set to enable the cam lock in the lock position to release upon an application of a predetermined force along the rack arm.

7. A panel assembly according to claim 1, wherein the cam lock includes an engaging member, a lever, and a spring member disposed between the engaging member and the lever, and wherein in the lock position, the engaging member is positioned to lock the rack arm by the over-center locking arrangement via the spring member.

8. A support bar assembly for a pivot member pivotably supported by a frame, the support bar assembly comprising:

a support arm body securable at an end to the frame;

a rack arm securable to the pivot member and slidably mounted in the support arm body between a closed position and an open position; and a cam lock affixed to the support arm body, the cam lock being movable between at least a release position, in which the rack arm is freely slidable in the support arm body, and a lock position, in which the rack arm is substantially fixed in the support arm body against movement toward both the closed position and the open position, wherein the support arm body comprises a lock member disposed between the cam lock and the rack arm, the cam lock urging the lock member against the rack arm in the lock position, and wherein the cam lock comprises an engaging member, a lever, and a spring member disposed between the engaging member and the lever, the engaging member engaging the lock member in the lock position.

9. A support bar assembly according to claim 8, wherein the spring member comprises a spring coefficient, and wherein the spring coefficient is set to enable the cam lock in the lock position to release upon an application of a predetermined force along the rack arm.

10. A support bar assembly according to claim 9, wherein the spring coefficient is set by a thickness of the spring member.

11. A support bar assembly for a pivot member pivotably supported by a frame, the support bar assembly comprising:

a support arm body securable at an end to the frame;

a rack arm securable to the pivot member and slidably mounted in the support arm body between a closed position and an open position; and a cam lock affixed to the support arm body, the cam lock being movable between at least a release position, in which the rack arm is freely slidable in the support arm body, and a lock position, in which the rack arm is substantially fixed in the support arm body against movement toward both the closed position and the open position, the cam lock including structure such that the cam lock is held in the lock position by an over-center locking arrangement, wherein the support arm body comprises a lock member disposed between the cam lock and the rack arm, the cam lock urging the lock member against the rack arm in the lock position, and wherein the lock member is integral with the support arm body.

12. A support bar assembly for a pivot member pivotably supported by a frame, the support bar assembly comprising:

a support arm body securable at an end to the frame;

a rack arm securable to the pivot member and slidably mounted in the support arm body between a closed position and an open position; and a cam lock affixed to the support arm body, the cam lock being movable between at least a release position, in which the rack arm is freely slidable in the support arm body, and a lock position, in which the cam lock is cooperable with a lock member to engage the rack arm, and the rack arm is substantially fixed in the support arm body against movement toward both the closed position and the open position, wherein the rack arm comprises an aluminum sleeve disposed surrounding a plastic strip defining a rack.

13. A support bar assembly according to claim 12, wherein the rack is defined by a plurality of arm ridges formed in the plastic strip.

14. An assembly for pivotably supporting a panel, the assembly comprising:

a panel frame pivotably supporting the panel via a hinge; and at least one support bar assembly secured adjacent the hinge between the panel frame and the panel, the support bar assembly including:

a support arm body secured at an end to the panel frame, a rack arm secured to the panel and slidably mounted in the support arm body between a closed position in which the panel is pivoted closed in the panel frame and an open position in which the panel is pivoted open in the panel frame, and a cam lock affixed to the support arm body, the cam lock being movable between at least a release position, in which the rack arm is freely slidable in the support arm body, and a lock position, in which the cam lock is cooperable with a lock member to engage the rack arm, and the rack arm is substantially fixed in the support arm body against movement toward both the closed position and the open position, wherein the cam lock comprises structure such that in the lock position, the cam lock substantially fixes the rack arm in the support arm body by an over-center locking arrangement.

15. An assembly according to claim 14, wherein the support arm body comprises a lock member disposed between the cam lock and the rack arm, the cam lock urging the lock member against the rack arm in the lock position.

16. An assembly according to claim 15, wherein the rack arm comprises a plurality of arm ridges defining a rack, and wherein the lock member comprises a plurality of locking ridges sized substantially corresponding to the arm ridges, the lock member being positioned such that the locking ridges are disposed facing the arm ridges.

17. An assembly according to claim 15, wherein the cam lock comprises an engaging member, a lever, and a spring member disposed between the engaging member and the lever, the engaging member engaging the lock member in the lock position.

18. An assembly according to claim 17, wherein the spring member comprises a spring coefficient, and wherein the spring coefficient is set to enable the cam lock in the lock position to release upon an application of a predetermined force along the rack arm.

19. An assembly according to claim 15, wherein the lock member is integral with the support arm body.

* * * * *